United States Patent [19]

Svy

[11] Patent Number: 4,786,911

[45] Date of Patent: Nov. 22, 1988

[54] APPARATUS FOR CIRCULARLY POLARIZED RADIATION FROM SURFACE WAVE TRANSMISSION LINE

[75] Inventor: Kosal Svy, Kent, Wash.

[73] Assignee: The Boeing Company, Seattle, Wash.

[21] Appl. No.: 119,026

[22] Filed: Nov. 10, 1987

[51] Int. Cl.[4] ..... H01Q 9/28; H01Q 1/30

[52] U.S. Cl. ..... 343/785; 343/707; 343/895

[58] Field of Search ..... 343/707, 785, 895, 773

[56] References Cited

U.S. PATENT DOCUMENTS 3,829,861 8/1974 Karaganis et al. ..... 343/707

4,675,690 6/1987 Hoffman ..... 343/895

*Primary Examiner*—William L. Sikes

*Assistant Examiner*—Doris J. Johnson

*Attorney, Agent, or Firm*—Christensen, O'Connor, Johnson & Kindness

[57] ABSTRACT

Disclosed is an arrangement of two conical radiators that electromagnetically interact with one another to produce circularly polarized radiation in a surface wave transmission system. One of the radiators includes an annular conductive region that coaxially surrounds the surface wave transmission line with a pair of spiral antenna arms extending outwardly along the conical surface of the radiator from oppositely disposed positions on the outer boundary of the annular conductive region. The second radiator, which is spaced apart from the first radiator, includes a circular conductive region to which the end of the surface wave transmission line is joined and further includes a pair of spiral antenna arms that extend outwardly along the surface of the second conical radiator. The annular opening in the first radiator is dimensioned so that one-half of the surface wave energy incident on the first radiator is radiated and the remaining one-half of the electromagnetic energy propagates through the circular opening of the annular conductive region and is radiated by the second radiator. The orientation between the first and second radiators is established both with respect to axial distance between the radiators and the spatial position of the inner ends of the spiral antenna arms to cause the individual signals radiated by the two radiators to combine in a manner that results in far field circular polarization.

11 Claims, 4 Drawing Sheets

APPARATUS FOR CIRCULARLY POLARIZED RADIATION FROM SURFACE WAVE TRANSMISSION LINE

BACKGROUND OF THE INVENTION

This invention relates to radiation of RF energy from a surface wave transmission line. More specifically, this invention relates to such an arrangement for transmitting and/or receiving RF energy wherein the arrangement exhibits circular polarization relative to the far field radiation pattern and, in addition, exhibits broad band characteristics.

As is known in the art, RF electromagnetic energy will propagate along a single conductor that is configured or treated to concentrate and confine the electromagnetic energy to a cylindrical volume that coaxially surrounds the conductor. This type of transmission line is known as a surface wave transmission line, a Goubau line or a G-line. In the more commonly known surface wave transmission lines, a conductor is surrounded by a coating of low-loss dielectric. Since the phase velocity of the electromagnetic energy that propagates through the dielectric coating is less than the free space phase velocity, at least the majority of the electromagnetic energy is confined to the dielectric and a cylindrical volume of space that concentrically surrounds the dielectric coating. Other techniques for suitably decreasing the phase velocity of the propagating signal also are known. For example, crimping an uncoated wire or machining thread-like grooves in the wire surface will cause a reduction in phase velocity in signals traveling along the wire, thereby causing the uncoated wire to act as a surface wave transmission line.

Since surface wave transmission lines provide a highly efficient transmission medium (low-loss operation) and will support electromagnetic wave propagation over a wide frequency range (broad band operation), application is found in various situations in which environmental conditions can accommodate the unique properties of a traveling surface wave. One such application is the transmission of RF energy along a wire towed by an aircraft such that no intermediate supports are required along the wire which might interfere and cause decoupling of the surface wave energy. One example of an aircraft-surface wave transmission line system that is equipped with means for controlled radiation at or near the end of the wire is disclosed in co-pending U.S. patent application Ser. No. 813,049, now U.S. Pat. No. 4,743,916, filed Dec. 24, 1985 by G. A. Bengeult and entitled "Method and Apparatus For Proportional RF Radiation from Surface Wave Transmission Line." In the system disclosed in the referenced patent application, an electromagnetic wave that is to propagate along the surface wave transmission line is coupled to the transmission line by a rearwardly facing horn-like surface wave "launcher." The launcher in effect serves as a transition between the surface wave transmission line and a coaxial cable or waveguide that serves as a feed line that interconnects the surface wave transmission line with the aircraft RF transmitter or transceiver.

In the radiation system disclosed in the referenced patent application, a series of two or more electrically conductive radiating elements that are spaced-apart by a distance greater than one wavelength (relative to the RF electromagnetic energy that propagates along the surface wave transmission line) are configured in a manner that causes a predetermined portion of the RF electromagnetic energy to become detached from and radiate outwardly from the line. When viewed from the far field, the result is that each radiator appears to be a separate source of radiation.

More specifically, an exemplary arrangement of the type of surface wave transmission line radiation system disclosed in the referenced patent application consists of a conductive conical radiator that is located at the aft terminus of a surface wave transmission line that is towed by an aircraft with the apex of the conical radiator being electrically connected to the transmission line. Located at least one wavelength in front of this radiator is a second radiator (or series of two or more radiators that are spaced apart by at least a wavelength). Each radiator that is located forward of the radiator at the end of the surface wave transmission line is frustoconical in geometry with the outer surface of each such radiator being formed of an electrically conducted material and with the smaller, truncated end of each such radiator facing toward the aircraft. In this arrangement, the surface wave transmission line passes through each frustoconical radiator with the opening that is defined by the smaller, truncated end of the radiator serving as a "window" that allows a predetermined portion of the RF electromagnetic energy that impinges on the radiator to continue propagating toward the end of the transmission line. The remaining portion of the RF electromagnetic wave energy that impinges upon a frustoconical radiator is detached from the line and radiated outwardly into space. Since the electric field (E vector) of the radiated electromagnetic energy is substantially parallel to the surface wave transmission line, the system disclosed in the referenced patent application provides horizontal polarization (with the towed surface wave transmission line considered to be horizontally oriented).

Although a multiple radiator system of this type or a more basic system in which a single electrically conductive conical radiator is attached to the end of a surface wave transmission line fulfills the need for a horizontally polarized, low-loss, broad band RF transmission and radiation system, a need exists for equally broad band and efficient systems that radiate circularly polarized electromagnetic energy. Specifically, in many applications the polarization direction of an antenna that is to receive energy radiated by a surface wave transmission and radiation system either is not known or the antenna (and hence its polarization direction) may change because of movement of the vehicle or structure upon which the antenna is mounted. In such situations and others, polarization mismatch will exist between the radiator used by the surface wave transmission line and the receiving antenna. This means that the electrical signal produced by the antenna will be at a substantially lower level than would be the case if the receiving antenna had the same polarization as the surface wave transmission line. Thus, when polarization mismatch occurs, there is a loss of system efficiency when considered in view of the amount of transmitted energy that is required to produce a desired receive level.

As is known in the art, polarization mismatch in transmitter-receiver situations in which the polarization direction of the receiving antenna is unknown can be eliminated by configuring the transmitting antenna so that the transmitted electromagnetic energy is circularly polarized. When this is done, the electric field factor (E) of the electromagnetic energy that is incident on the receiving antenna rotates in space at a constant angular velocity $\omega$ radians per second, where $\omega=2\pi f$ with f representing the frequency of the transmitted signal in cycles per second. Thus, regardless of the polarization direction of the receiving antenna, maximum electrical coupling will occur once each angular cycle of the E field to thereby result in maximum coupling to the receiving antenna and hence, maximum signal output from the antenna.

Various techniques and antenna construction are known for transmitting circularly polarized electromagnetic energy, with the type and configuration of the transmitting antenna generally depending upon the configuration of the transmission system to be used with the antenna and other factors. In this regard, although the prior art apparently does not address adapting or configuring a surface wave transmission line for radiating circularly polarized electromagnetic energy, one type of circularly polarized antenna that is relevant to the present invention is a center-fed multi-arm spiral antenna. As is known in the art, such spiral antennas include a plurality of antenna arms that are spaced apart from one another and spiral outwardly from associated signal input terminals or feed points that are equally spaced apart from one another along the circumference of a small circle that is located at the center of the antenna. Typically, the conductive antenna arms are mounted on or formed in the surface of a dielectric material that can be planar or of some other geometrical configuration such as conical. Further, it is known that a center-fed multi-arm spiral antenna having N arms or elements is capable of N-1 in dependent modes of operation by suitably establishing the phase difference between the excitation currents that are supplied to the feed points of the antenna arms. In this regard, a first mode of operation (i.e., $M=1$) is obtained when the phase different between adjacent feed points (and hence antenna arms) is numeral $2\pi/N$. Operation in the $M=1$ mode is commonly referred to as operation in the "sum" mode and produces a single-lobed radiation pattern that exhibits maximum field strength along, and symmetric about, the antenna boresite axis. Higher order modes (i.e., $M=2, 3, \ldots (N-1)$), often are called "difference" modes and are obtained by feeding the antenna such at the phase difference between adjacent arms is $2\pi M/N$. Operation in a difference mode produces a radiation pattern that exhibits a null along the antenna boresite and maximum field strength along a cone of revolution about the boresite. In this respect, as the mode number increases a larger cone angle is exhibited between the imaginary line of maximum field strength and the antenna boresite axis and a decrease in relative field strength is exhibited.

Although circular polarization has been satisfactorily achieved in many situations by utilizing spiral antennas or other arrangements, the prior art has not yielded a satisfactory circularly polarized radiation arrangement for situations in which the electromagnetic energy being radiated travels along a surface wave transmission line (i.e., situations in which the antenna feed line is a surface wave transmission line). Since, as previously noted, a surface wave transmission line provides a low-loss broad band signal transmission medium, need exists for an arrangement that can be fed from such a surface wave transmission line for radiation of a circularly polarized signal. This is especially true of arrangements such as the type of previously mentioned surface wave transmission line-radiation system that is towed by an aircraft where efficient communication is necessary or desired relative to receiving antennas that exhibit an unknown or variable polarization direction.

SUMMARY OF THE INVENTION

These and other objects are achieved in accordance with this invention by an arrangement of radiators that are spaced apart from one another along the aft portion of a surface wave transmission line with the rearmost radiator being at the terminus of the transmission line. Each radiator is of smoothly increasing diameter relative to the direction in which electromagnetic wave energy propagates along the surface wave transmission line with each radiator being configured for causing detachment from the line (radiation) of a predetermined portion of the incident electromagnetic energy. Each radiator includes space-apart conductive antenna arms that are mounted on (or formed in) the surface of the radiator and spiral outwardly from the radiator central region. The spacing between the two radiators is established to cause the energy radiated by each individual radiator to be combined in a phase relationship that results in far field circular polarization.

Two radiators of substantially conical configuration are utilized in the currently preferred embodiments of the invention with the surfaces of each radiator including a metallization pattern that is similar to that of a conically-shaped two arm spiral antenna. The inner ends of the two spiral antenna arms of the rearmost radiator are oppositely disposed from one another along the circumference of a circular conductive region that is formed at the apex of the conically-shaped rear radiator. Rather than including a solid circular conductive region, the apex of the forwardmost radiator includes an annular conductive region with the two inner ends of the antenna arms of the forwardmost radiator being oppositely disposed from one another along the outer circumference of the annular conductive region. In this arrangement, the surface wave transmission line passes coaxially through the annular conductive region of the forwardmost radiator, with the end of the transmission line being electrically connected to the center of the circular conductive region of the rearmost radiator.

The circular area that is surrounded by the annular conductive region of the forwardmost radiator serves as a "window" that allows a predetermined portion of the electromagnetic energy propagating along the surface wave transmission line to pass through the forwardmost radiator for impingement on the rearwardmost radiator. The portion of the electromagnetic energy that does not pass through this window induces currents in the two spiral antenna arms thereby causing electromagnetic energy to be radiated from the antenna arms. Since the apex region of the rearmost radiator is a conductor, no electromagnetic energy passes through the rearmost radiator. That is, substantially all of the electromagnetic energy that passes through the forwardmost radiator induces current in the antenna arms of the rearmost radiator to thereby cause further radiation of electromagnetic energy.

In accordance with the invention, far field circular polarization is attained in the currently preferred embodiments in the invention by controlling both the amount of electromagnetic energy that passes through the forwardmost radiator for radiation by the rearmost radiator and by controlling the spatial orientation of the radiators relative to one another. With respect to controlling the amount of energy that reaches the rearmost radiator, the circular opening or window in the foremost radiator is dimensioned so that one half of the energy incident on the forwardmost radiator passes rearwardly to the rearmost radiator and the remaining one-half of the incident energy is radiated into space. To establish conditions under which the electromagnetic energy radiated by the forwardmost radiator (half the total energy that propagates along the surface wave transmission line) is combined with the energy that is radiated by the rearwardmost radiator (the remaining half of the energy propagating along the transmission line) in a manner that results in far field circular polarization, the spatial orientation of the radiators is controlled both with respect to the distance between the radiators and with respect to spatial orientation of the two antenna arms of the forwardmost radiator relative to the spatial orientation of the antenna arms of the rearwardmost radiator. Firstly, with respect to spatial positioning between the two pairs of antenna arms, the radiators are oriented so that an imaginary line that extends between the diametrically opposed inner ends of the antenna arms of the forwardmost radiator is perpendicular to an imaginary line that extends between the diametrically opposed inner ends of the antenna arms of the rearmost radiator. That is, if viewed in the direction defined by the transmission line so that the antenna arm pattern of the forwardmost radiator in effect is superimposed on the antenna arm pattern rearwardmost radiator, the resulting antenna arm configuration would be like that of a four-arm spiral antenna, with the inner ends of the four antenna arms lying on a circle and being spaced-apart from one another by 90°. With respect to the spacing of the two radiators from one another in the axial direction (along the surface wave transmission line), the distance between the apexes of the radiators is established at $\lambda_U/8$ where $\lambda_U$ represents the wavelength of the highest frequency signal to be transmitted and the distance between the outer ends of the radiators is established equal to $\lambda_L/8$, where $\lambda_L$ represents the wavelength of the lowest frequency of the signals to be radiated. This spacing ensures that the energy radiated by the two individual radiators will be combined in the proper phase relationship throughout the frequency band defined by the frequencies associated with $\lambda_L$ and $\lambda_U$.

BRIEF DESCRIPTION OF THE DRAWING

Other features will become apparent from the following description which is given as an example and which is illustrated by the accompanying drawing in which.

DETAILED DESCRIPTION

Figure 1:
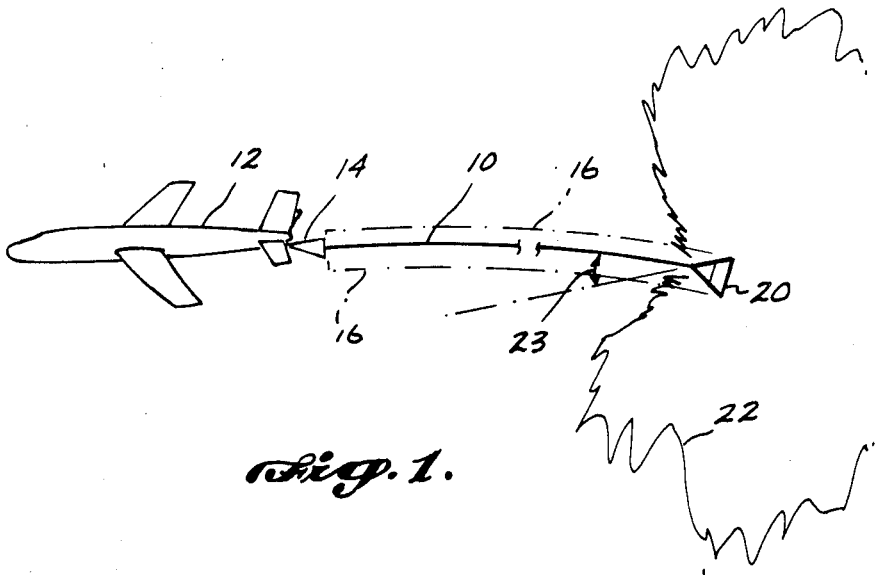
FIG. 1 is a schematic view of an RF transmission and radiation system of the type that can advantageously employ the invention.

With reference to FIG. 1, in one type of RF transmission and radiation system that can advantageously employ the invention, a surface wave transmission line 10 is extended rearwardly from an aircraft 12. In this arrangement, an RF transmitter that is located within aircraft 12 (not shown in FIG. 1) couples the electromagnetic energy to be radiated by the system to a launcher 14 which is located at the forward end of surface wave transmission line 10 (i.e., adjacent the tail section of the aircraft 12). Launcher 14 serves as an interface between the transmission medium of the RF aircraft transmission system (e.g., coaxial cable or waveguide) and the surface wave transmission line. Various arrangements are known in the art that can be employed as launcher 14 of FIG. 1. For example, one such device is disclosed and claimed in co-pending U.S. patent application Ser. No. 913,774, now U.S. Pat. No. 4,730,172 filed Sept. 30, 1986 by G. A. Bengeult, which is entitled "Launcher For Surface Wave Transmission Lines," and is assigned to the assignee of this invention.

Figure 2:
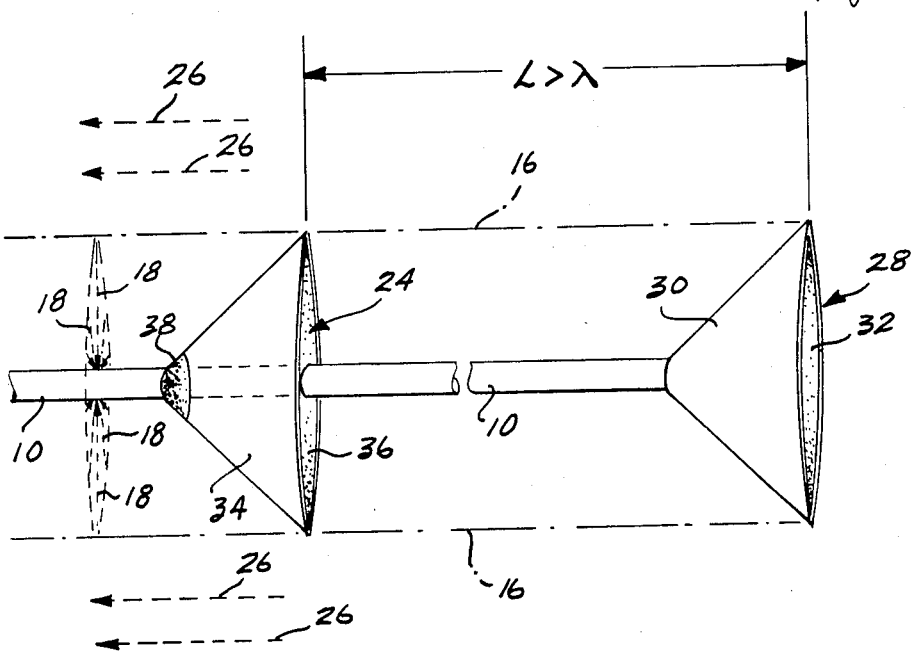
FIG. 2 is useful in understanding certain aspects of the invention and illustrates two conically-shaped radiators that are spaced-apart from one another along the terminal region of a surface wave transmission line.

Regardless of the exact configuration of launcher 14, the launcher causes RF energy supplied by the aircraft transmission system to be coupled onto the surface wave transmission line 10 as a traveling "bundle" of wave energy. In this regard, as is known to those familiar with surface wave transmission lines, coating the outer surface of a conductive wire with low-loss dielectric machining grooves and/or crimping the wire establishes a transmission environment in which the phase velocity of the electromagnetic signal traveling along the wire is less than the free space phase velocity of that signal. This, in turn, confines the electromagnetic field to a cylindrical region in space ("energy tube") that concentrically surrounds the wire. Such region being indicated in FIG. 1 and 2 by phantom lines 16. As is indicated in FIG. 2 by the dashed arrows 18, the electric field vectors (E vectors) of the electromagnetic field that surrounds the surface wave transmission line are perpendicular to the transmission line and extend radially between the outer diameter of the energy tube 16 and surface wave transmission line 10.

Mounted at the distal end of surface wave transmission line 10 of FIG. 1 is a radiator 20 of conical or other aerodynamically stable geometry. In systems previously developed by the assignee of this invention, radiator 20 includes either a single radiating element or a plurality of spaced-apart radiating elements. For example, in one such arrangement radiator 20 is conical with the outer surface being formed of an electrically conductive material. In operation, the electromagnetic energy traveling along surface wave transmission line 10 impinges upon radiator 20 and is reflected therefrom so that the energy becomes detached from surface wave transmission line 10 to form a radiation pattern that is indicated in FIG. 1 by the region bounded by line 22. As is indicated in FIG. 1, the radiation pattern includes a substantially conical null region that is symmetrically disposed about transmission line 10 and extends forwardly toward aircraft 12, with the angle between surface wave transmission line 10 and the outer boundary of the null region being defined by an aspect angle 23.

When equipped with a radiator 20 of the above-described type, an RF surface wave transmission and radiation system such as that depicted in FIG. 1 produces a radiated electromagnetic field having a predetermined polarization. In this regard, and with reference to FIG. 2, when the electromagnetic energy traveling within energy tube 16 impinges on a conductive radiator (denoted by the numeral 24 in FIG. 2), the electric field vectors associated with the radiated energy (identified by dashed arrows 26 in FIG. 2) are substantially parallel to surface wave transmission line 10. Thus, the radiated field is polarized in the direction in which the surface wave transmission line extends. Since surface wave transmission line 10 in the system of FIG. 1 is substantially horizontal, it thus can be recognized that a horizontally polarized signal is radiated by the depicted system.

Figure 3:
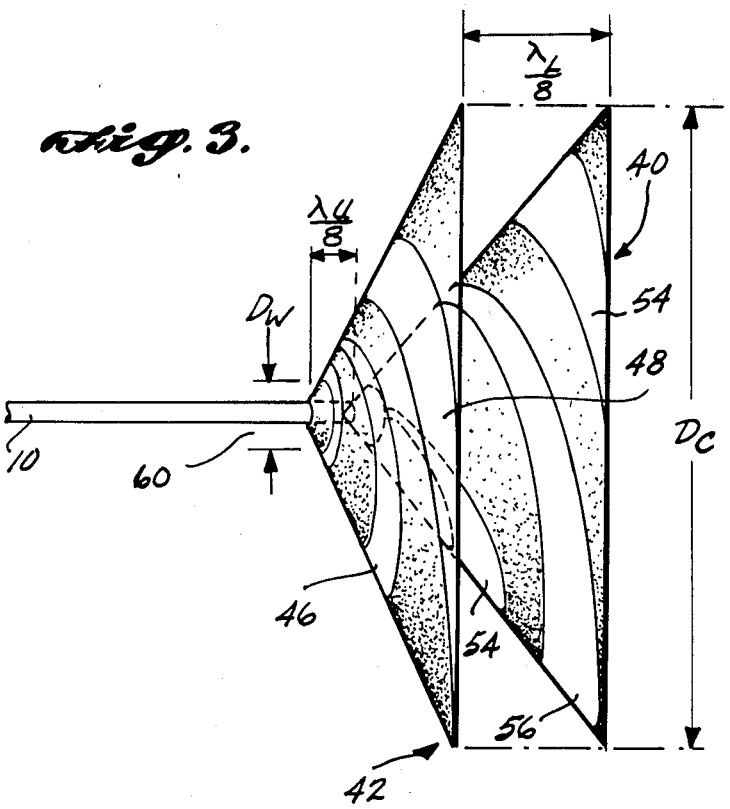
FIG. 3 is a side elevational view of an embodiment of the invention which employs two spaced-apart conical radiators, each of which include a pair of antenna arms that spiral outwardly along the outer surface of the radiator.
Figure 4:
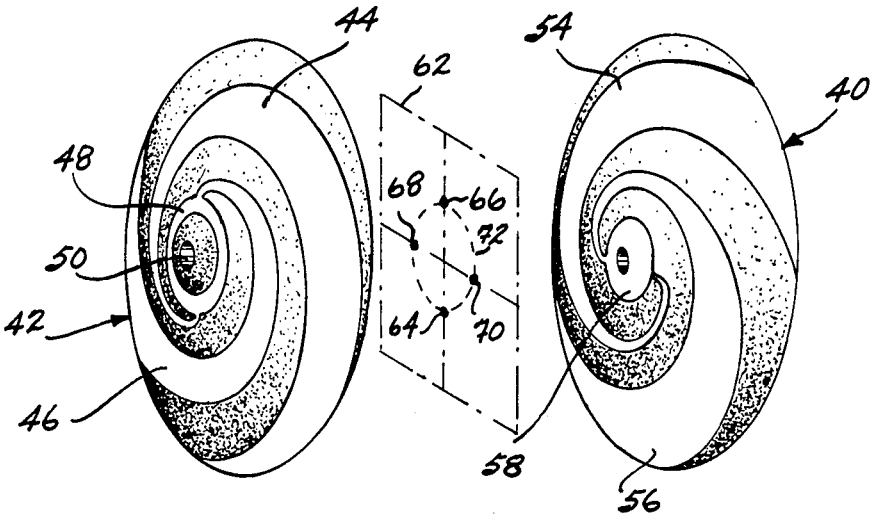
FIG. 4 is a simplified isometric view of the two radiators of the arrangement in FIG. 1 which illustrates additional detail of the radiators, and, in addition, illustrates the spatial orientation of the spiral antenna arms of one radiator with respect to the spiral antenna arms of the second radiator.
Figure 5:
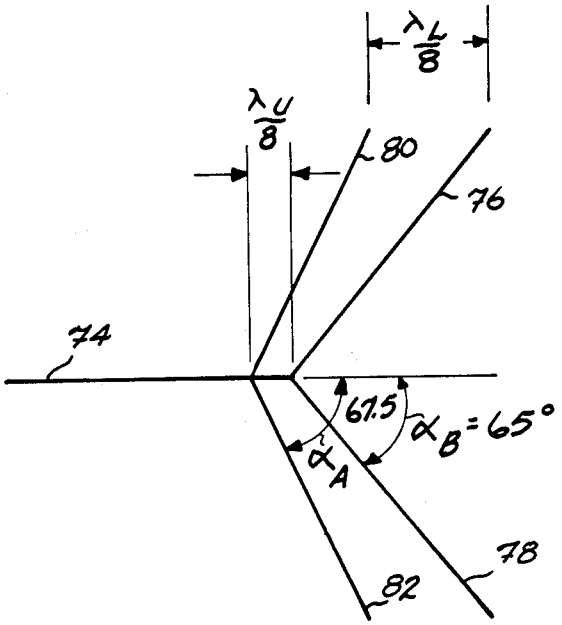
FIG. 5 is a diagram that illustrates in schematic form the spacing between the conical radiators of FIG. 3 and, in addition, the cone angles thereof.

As shall be recognized upon understanding the exemplary embodiment of the invention that shall be described relative to FIGS. 3–5, the present invention utilizes two radiators that are configured and positioned relative to one another so as to individually produce electromagnetic radiation that is combined (i.e., interacts) so as to couple a circularly polarized signal to the far field. Prior to undertaking a more detailed structural description of the invention, reference should be taken to FIG. 2, which illustrates the basic manner in which electromagnetic energy traveling along a surface wave transmission line is coupled to and radiated by the two radiators of the invention.

More specifically, FIG. 2 illustrates the terminal portion of an RF surface wave transmission and radiation system that is exemplary of the various arrangements disclosed and claimed in co-pending U.S. patent application Ser. No. 813,049, filed Dec. 24, 1985 by G. A. Bengeult, which is entitled "Method and Apparatus For Proportion RF Radiation From Surface Wave Transmission Line," and which is assigned to the assignee of this invention. In the arrangement of FIG. 2, a conically-shaped radiator 28 is connected to the terminus of surface wave transmission line 10 with the entire outer surface of radiator 28 being formed by a layer of electrically conductive material 30. As is described in more detail in the referenced patent application, conductive layer 30 can be a copper or silver foil that is formed to the exterior surface of a support 32, which can be carved or otherwise formed from a block of expanded polystyrene foam or other suitable material. Preferably the dielectric constant of the material utilized for support 32 exhibits a dielectric constant similar to that of air so that support 32 has little or no effect on the electromagnetic energy radiated by radiator 28.

Located forward or upstream of radiator 28 by a distance that is greater than the free space wavelength of the signal being transmitted is a second radiator 24. Radiator 24 is similar in construction to radiator 28, basically consisting of a conductive layer 34 that extends about the outer surface of a conically-shaped support 36. Radiator 24 differs from radiator 28 in that conductive layer 34 is of frustoconical geometry to thereby form a circular opening or "window" (38, in FIG. 2). Surface wave transmission line 10 pass coaxially through window 38 and along the axial centerline of radiator 24, with support 36 being bonded or otherwise attached to surface wave transmission line 10 to position radiator 24 at least one free space wavelength away from radiator 28.

As is described in detail in the previously referenced patent application, in the arrangement of FIG. 2, electromagnetic energy propagating along surface wave transmission line 10 is confined within the boundaries of energy tube 16 until the traveling electromagnetic energy reaches radiator 24. In this regard, a portion of the energy incident on radiator 24 passes through window 38 of radiator 24 for continued propagation toward radiator 28. The portion of the electromagnetic energy that is incident on radiator 24 but does not pass through window 38 is reflected from radiator 24 and radiated into space in the previously described manner. Since radiator 28 does not include a window or opening, all of the energy that impinges on radiator 28 also is radiated into space in the previously described manner. Since the radiators are spaced apart from one another by a distance greater than the free space wavelength of the energy being radiated, radiators 24 and 28 produce horizontally polarized signals which, in the far field, appear to have been generated by separate, discrete sources.

As also is described in more detail in the referenced patent application, the amount of energy that passes through window 38 of radiator 24 is determined by the diameter of the window. In this regard, since the ratio between the energy that propagates through the window and the energy that is radiated is a function of various system design parameters such as frequency, the effective diameter of energy tube 16 and radiator cone angle, there is no easily expressed mathematical relationship for obtaining a desired vision of the energy into radiated and transmitted energy. However, it has been determined that the amount of energy that passes through the window initially increases in a somewhat linear fashion until a certain window diameter is reached, with further increases in window diameter not having much affect on the ratio between transmitted and radiated energy. Thus, in an arrangement such as that depicted in FIG. 2 and in the hereinafter discussed arrangement of the invention, a certain amount of empirical testing is required in order to determine proper window diameter.

Referring now to FIGS. 3–5, the circularly polarized radiation arrangement of this invention includes a radiator 40 that is electrically connected at the terminus of the surface wave transmission line 10. In the depicted embodiment, radiator 40 is of substantially conical geometry with the base diameter, $D_C$, preferably being equal to the diameter of the energy tube of the surface wave transmission system utilizing the invention. Located forwardly of radiator 40 (i.e., toward the source of electromagnetic energy that travels along the surface wave transmission line 10) is a second radiator 42. In the depicted embodiment, radiator 42 also is of conical geometry with surface wave transmission line 10 passing through the apex of the radiator.

As indicated in FIG. 3 and as can best be seen in FIG. 4, both radiator 40 and radiator 42 include electrically conductive regions or metallization that form a pattern similar to that of a two-arm spiral antenna. More specifically, the conductive pattern of radiator 42 includes two spiral arms 44 and 46 that extend outwardly from oppositely disposed positions along the outer edge of an annular conductive region 48. Annular conductive region 48 coaxially surrounds an opening 50 through which surface wave transmission line 50 passes. In the depicted arrangement each spiral arm 44 and 46 (and the hereinafter described spiral arms 54 and 56 of radiator 40) is in the form of a logarithmic spiral in which the tangent is inclined at a constant angle with respect to the radius (i.e., an equal angle logarithmic spiral).

As also is best seen in FIG. 4, the metallization pattern of radiator 40 includes two conductive spiral arms 54 and 56 with the inner ends thereof being diametrically opposed from one another along the boundary of a circular conductive region 58 that is formed at the apex of radiator 40. The pair of spiral arms 54 and 56 of radiator 40 are substantially identical to the pair of spiral arms 44 and 46 of radiator 24, except for the metallization pattern that interconnects each pair of arms.

Various techniques and methods can be utilized to realize radiators 40 and 42. For example, the radiators can be formed in the manner described previously with respect to the referenced patent application of Bengeult that discloses and claims a surface wave transmission and radiation system wherein conductive surfaces of the disclosed radiators are defined by metal foil that is formed on suitably shaped supports of polystyrene foam or other such material. In addition, radiators 40 and 42 can be formed from suitably shaped metal clad dielectric sheets (such as those utilized for producing printed circuits, strip-line transmission lines and small antennas) by means of standard photographic and chemical etching processes.

Regardless of the techniques utilized to construct radiators 40 and 42, radiator 42 is bonded or otherwise secured to a section of surface wave transmission line that passes through axial opening 50 with the terminus of the transmission line being electrically connected to the center of circular conductive region 58 of radiator 40. In operation, the electromagnetic energy that propagates along surface wave transmission line 10 is divided into radiated energy and transmitted energy in a manner similar to that described relative to FIG. 2. In particular, the opening defined by the inner edge of conductive annular region 48 of radiator 42 defines an opening or window (60 in FIG. 3; diameter $D_W$) through which a portion of the incident electromagnetic energy passes. The energy that does not pass through window 60 induces current in spiral arms 44 and 46 of radiator 42 thereby causing that portion of that energy to be radiated into space. Because circular conductive region 58 of radiator 40 does not include a window or opening, all of the energy that is incident on radiator 40 induces current in spiral arms 56 and 58, thereby causing substantially all of the energy that passes through window 60 of radiator 42 to be radiated into space.

In concept, radiators 40 and 42 are dimensioned and spatially oriented to achieve circularly polarized radiation that is similar to the radiation produced by a center-fed, four-arm spiral antenna. To achieve this, the diameter $D_W$ of window 60 of radiator 42 is dimensioned so that one-half of the energy incident on radiator 42 is radiated into space by antenna arms 44 and 46 and the remaining one-half of the energy incident on radiator 42 is radiated into space by antenna arms 54 and 56 of radiator 40. Further, two constraints are imposed to ensure that the electromagnetic signals radiated by radiators 40 and 42 combine with one another in phase quadrature so that uniform circular polarization is attained. The first constraint on the orientation between radiators 40 and 42 can be seen with reference to FIG. 4. More specifically, in FIG. 4 there is shown an imaginary plane 62 that is located between the depicted radiators 40 and 42. Projected onto this imaginary plane are the inner ends of spiral arms 44, 46, 54 and 56, which are respectively indicated on imaginary plane 62 by points 64, 66, 68 and 70. As can be seen in FIG. 4, the four points representing the inner ends of the four antenna arms are equally spaced about a circle 72. Considered in a somewhat different manner, if the metallization pattern of radiator 42 in FIG. 1 is superimposed on the metallization pattern of radiator 40, the resulting metallization pattern would be like that of a conventional four arm, spiral antenna, except for the central region, which would consist of annular conductive region 48 of radiator 42 superimposed over circular conductive region 58 of radiator 40. Although not absolutely necessary, in the currently preferred embodiments of the invention, it can be noted that the diameter of circular conductive region 58 of radiator 40 is substantially equal to the diameter of the window 60 ($D_w$) of radiator 42.

The second constraint that preferably is imposed on the spatial orientation of radiators 40 and 42 so that circularly polarized radiation is obtained is indicated in FIG. 3 and is more clearly shown in FIG. 5. More specifically, in FIG. 5, a line 74 represents the axial centerline of surface wave transmission line 10 of FIG. 1. Radiator 40 is represented by lines 76 and 78 that extend angularly away from line 74 and radiator 42 is represented in a similar manner by lines 80 and 82 that extend angularly away from line 74. As can be seen in the resulting diagram of FIG. 5, the apex of radiator 40 is spaced apart from the apex of radiator 42 by a distance that is equal to $\lambda_U/8$, where $\lambda_U$ is the wavelength of the highest frequency signal of concern (highest frequency of the band of transmitted signals). In addition, it can be seen that the outer edges of radiators 40 and 42 are spaced apart by a distance $\lambda_L/8$, where $\lambda_L$ is the wavelength of the lowest frequency of concern.

The axial orientation depicted in FIG. 5 is utilized in accordance with this invention because radiation of the highest frequency signal of the band of signals included in the incident electromagnetic wave is produced within an annular region of radiators 40 and 42 that is near the surface wave transmission line 10, and radiation of the lowest frequency signal occurs within an annular region that is at or near the outer boundaries of radiators 40 and 42. Thus, the spacing shown in FIG. 5 and discussed above causes the signals that pass through window 60 of radiator 42 to undergo a phase shift of $\lambda/8$ (45°) before being incident on radiator 40, with such phase shift occurring for each frequency within the system bandwidth. This means that all signal components of the electromagnetic field radiated by radiators 40 and 42 are 45° out of phase with one another. Since the electromagnetic signals radiated by radiators 40 and 42 must travel through space a distance that is also equal to $\lambda/8$ (45°) at each transmitted frequency before the signals mix or combine with one another, the axial spacing shown in FIG. 5 results in radiation in which the signal components at each frequency within the transmitted band of signals is in phase quadrature. This feature, combined with the previously-described orientation of the inner ends of the spiral arms of radiators 40 and 42, results in far field circular polarization throughout the bandwidth of interest.

In view of the above discussion, it can be noted that the cone angle of radiator 42 (represented by half angle $\alpha_A$ in FIG. 5) will be greater than the cone angle of radiator 40 (represented in FIG. 5 by half angle $\alpha_B$)

when the invention is embodied in the currently preferred manner. In this regard, it can be noted that equal angular conically-configured radiators can be employed (e.g., with the radiators being spaced apart by $\lambda_C/8$, where $\lambda_C$ represents the wavelength of the center frequency of the transmission bandwidth) with some loss of uniformity of circular polarization. Further, with respect to cone angle, it should be noted that the angles selected control the overall radiation pattern. That is, increasing cone angle (while maintaining the desired axial between radiators 40 and 42) results in narrowing of the radiation pattern, which is indicated by 22 in FIG. 1). That is, as the cone angles of radiators 40 and 42 increase, the radiation pattern that is produced tends to more closely approximate a single lobe that extends rearwardly from radiators 40 and 42 (i.e., rearwardly along the axis of the surface wave transmission line). Conversely, decreasing the cone angles results in a broader radiation lobe.

As previously mentioned, various techniques can be employed to suitably realize or construct radiators 40 and 42. In addition, it should be noted that in certain situations it may be advantageous to join radiators 40 and 42 so as to form a unitary structure. Specifically, in relatively high frequency applications of the invention, the spacing between radiators 40 and 42 is relatively small. For example, in one realization of the hereindescribed embodiment of the invention, radiators 40 and 42 are configured so as to operate over a frequency range extending between 8 and 12 gigahertz with the energy bundle that impinges on the radiators exhibiting a diameter of approximately 10 centimeters (4 inches). In this arrangement, the axial spacing between the apexes of the radiators is on the order of 0.3125 centimeters (approximately ⅛ inch) and the preferred spacing between the outer edge of the radiators is 0.46875 centimeters (approximately 11/64 inch). Thus, it can be recognized that fairly precise positioning of the radiators in this and similar realizations of the invention is required. To achieve and maintain such a result, the radiators can be bonded or joined together by various known compounds, such as two-part epoxy resins. In such a situation, either a bonding material is selected that exhibits a dielectric constant substantially equal to that of air or the distance between the radiators is adjusted to compensate for the relative dielectric constant of the material.

Figure 6:
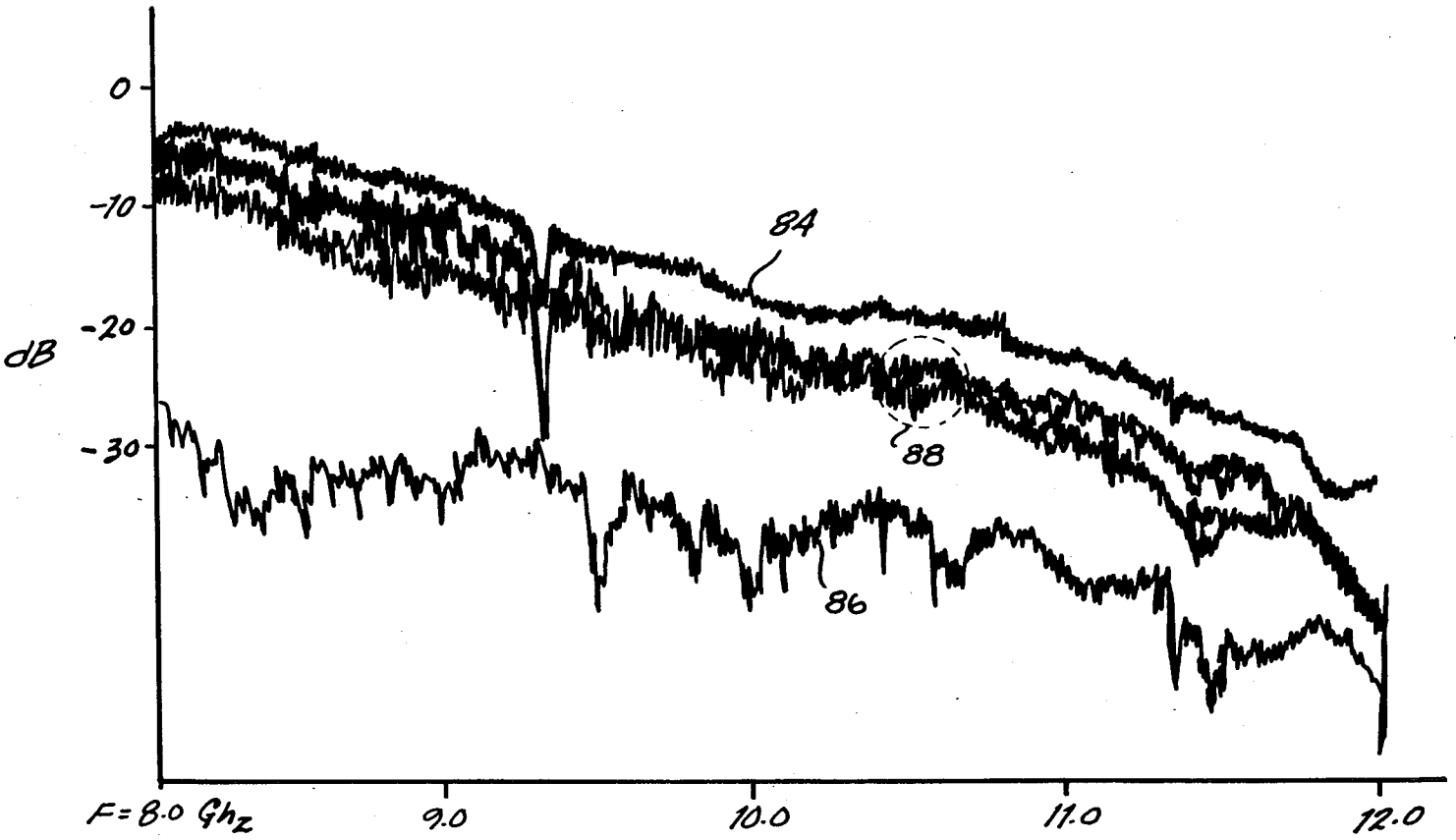
FIG. 6 is a graph that depicts various polarization components of one particular realization of the invention over a band of transmission frequencies.

Regardless of the exact techniques utilized to construct the radiator arrangement of the invention, it has been found that the invention can provide far field circularly polarized radiation with the axial ratio between the vertical and horizontal components differing by less than one decibel. For example, the far field energy components of the previously-mentioned realization of the invention for operation over a bandwidth of 8 to 12 gigahertz is shown in FIG. 6, where, in addition to the previously-mentioned design values, radiator 40 exhibited a cone angle of 130° and, to achieve the previously-described axially spacing between radiators, radiator 40 exhibited a cone angle of 135°. In FIG. 6, the upper tracing 84 provides a reference that indicates the horizontally polarized component of a prior art conical radiator having a conductive surface and exhibiting a 135° cone angle. The lower tracing 86 provides a reference that indicates the vertically polarized component of the prior art reference radiator. Located slightly below reference 84 in FIG. 6 is a group of four traces (collectively identified in FIG. 6 by the numeral 88). These traces indicate: the far field vertical polarization component of the above-described embodiment of the invention; two polarization components that are at ±45° angles to the vertical; and, a polarization component that is orthogonal to the vertical (i.e., the horizontal polarization component). As can be recognized in view of the closely-spaced relationship between the far field components 88, substantially uniform circular polarization is achieved with the axial ratio between the vertical and horizontal components differing by less than one decibel throughout the signal bandwidth.

While only particular embodiments have been disclosed, it will be readily apparent to persons skilled in the art that numerous changes and modifications can be made thereto, including the use of equivalent means and devices, without departing from the scope and the spirit of the invention.

The embodiments of the invention in which an exclusive property or privilege is claimed are defined as follows:

1. A radio frequency transmission and radiation system comprising: a surface wave transmission line adapted for transmission of an RF surface wave along said surface wave transmission line in a direction toward one terminus of said surface wave transmission line with the electromagnetic field of said RF surface wave being substantially confined to a substantially cylindrical energy bundle that concentrically surrounds said surface wave transmission line;

a first radiator attached to said terminus of said surface wave transmission line, said first radiator being of increasing cross-sectional geometry relative to the direction in which said RF surface wave travels along said surface wave transmission line, said first radiator defining an outer surface that includes a first electrically conductive pattern, said first electrically conductive pattern including an electrically conductive region that is centrally located on said surface of said first radiator with said surface wave transmission line being attached to said electrically conductive central region and said electrically conductive central region exhibiting an area greater than the cross-sectional area of said surface wave transmission line, said first electrically conductive pattern further including a plurality of electrically conductive arms that are spaced apart from one another and are electrically interconnected to said centrally located electrically conductive region, each of said arms spiraling outwardly along said outer surface of said first radiator; and a second radiator that is attached to said surface wave transmission line, said second radiator being of increasing cross-sectional area relative to the direction in which said RF surface wave travels along said surface wave transmission line, said second radiator defining an outer surface that includes a second electrically conductive pattern that includes an annular conductive region that concentrically surrounds said surface wave transmission line and further includes a plurality of electrically conductive arms that are spaced apart from one another and are electrically connected to said annular conductive region, each of said arms spiraling outwardly along said surface of said second radiator; said attachment of said second radiator to said surface wave transmission line establishing a predetermined distance relationship between said surface of said first radiator and said surface of said second radiator, said second radiator being further oriented relative to said first radiator to establish a predetermined spatial relationship between said arms of said first and second radiators, said spatial relationship between said arms of said first and second radiators and said predetermined distance relationship between said surfaces of said first and second radiators resulting in combined far field radiation by said first and second radiators that exhibits circular polarization.

2. The radio frequency transmission and radiation system of claim 1, wherein:

said plurality of electrically conductive arms in said conductive pattern of said first radiator consists of two spirally extending arms having inner ends that are electrically connected to said centrally located conductive region at oppositely disposed locations on the boundary of said centrally located conductive region;

said plurality of electrically conductive arms of said conductive pattern of said second radiator consists of two arms having inner ends that are electrically connected to oppositely disposed positions along the boundary of said conductive annular region;

said surfaces defined by said first and second radiators are separated from one another by a distance that is substantially equal to one-eighth of a wavelength for at least one frequency of said RF surface wave; and said annular conductive region of said conductive pattern of said second radiator is dimensioned to define an interior region that causes one-half of said electromagnetic energy of said RF surface wave to be radiated into space by said second radiator while allowing the remaining one-half of said electromagnetic energy of said RF surface wave to travel toward said first radiator for radiation into space by said first radiator.

3. The radio frequency transmission and radiation system of claim 2, wherein said second radiator is further oriented with respect to said first radiator so that an imaginary line drawn between said inner ends of said two arms of said first radiator orthogonally intersects in space with an imaginary line that extends between said inner ends of said two arms of said second radiator.

4. The radio frequency transmission and radiation system of claim 3, wherein the distance relationship between said surface of said first radiator and said surface of said second radiator is established so that the distance between said surfaces is substantially equal to $\lambda_U/8$ when measured between the attachment points of said first and second radiators to said surface wave transmission line, with $\lambda_U$ representing the free space wavelength of the highest frequency in a band of frequencies that is to be radiated by said system; and wherein the distance between the outer boundaries of said surfaces is substantially equal to $\lambda_L/8$, where $\lambda_L$ represents the lowest frequency signal in said bandwidth of signals.

5. The radio frequency transmission and radiation system of claim 4, wherein each said arm of said first and second conductive patterns is an equiangular spiral arm and said arms are dimensioned such that superposition of the arms of said first conductive pattern onto the arms of the second conductive pattern forms a composite pattern that is substantially identical to a four-armed, center-fed spiral antenna.

6. The radio frequency transmission and radiation system of claim 5, wherein said interior region of said annular conductive pattern of said second radiator defines a circle and wherein said centrally located conductive region of said conductive pattern of said first radiator is circular and exhibits a diameter substantially identical to the diameter of said interior region of said annular conductive region of said second radiator.

7. The radio frequency transmission and radiation system of claim 6, wherein said surfaces of said first and second radiators are of conical geometry and wherein the cone angle associated with said second radiator is greater than the cone angle associated with said first radiator to space apart the outer boundaries of said surfaces by said distance that is substantially equal to $\lambda_L/8$ when the apexes of said conical surfaces are spaced apart by said distance that is substantially equal to $\lambda_U/8$.

8. The radio frequency transmission and radiation system of claim 2, wherein said surfaces of said first and second radiators are of conical geometry and wherein the cone angle associated with said second radiator is greater than the cone angle associated with said first radiator to space apart the outer boundaries of said surfaces by said distance that is substantially equal to $\lambda_L/8$ when the apexes of said conical surfaces are spaced apart by said distance that is substantially equal to $\lambda_U/8$.

9. The radio frequency transmission and radiation system of claim 8, wherein said second radiator is further oriented with respect to said first radiator so that an imaginary line drawn between said inner ends of said two arms of said first radiator orthogonally intersects in space with an imaginary line that extends between said inner ends of said two arms of said second radiator.

10. The radio frequency transmission and radiation system of claim 9, wherein said interior region of said annular conductive pattern of said second radiator defines a circle and wherein said centrally located conductive region of said conductive pattern of said first radiator is circular and exhibits a diameter substantially identical to the diameter of said interior region of said annular conductive region of said second radiator.

11. The radio frequency transmission and radiation system of claim 10, wherein each said arm of said first and second conductive patterns is an equiangular spiral arm and said arms are dimensioned such that superposition of the arms of said first conductive pattern onto the arms of the second conductive pattern forms a composite pattern that is substantially identical to a four-armed, center-fed spiral antenna.

* * * * *